United States Patent [19]

Calvert

[11] 4,357,018

[45] Nov. 2, 1982

[54] PENTAGONAL GAME EQUIPMENT

[76] Inventor: Murray B. Calvert, 745 Rowntree Ave., London, Ontario, Canada, N6C 2L9

[21] Appl. No.: 63,053

[22] Filed: Aug. 2, 1979

[51] Int. Cl.[3] ..... A63F 3/00

[52] U.S. Cl. ..... 273/261; 273/236

[58] Field of Search ..... 273/255, 260–262, 273/236, 294; D21/21, 32, 33, 35

[56] References Cited

U.S. PATENT DOCUMENTS

| | | | |
|---|---|---|---|
| 282,990 | 8/1883 | Johnson | 273/276 |
| 1,373,448 | 4/1921 | Preginauskas | 273/261 |
| 1,552,354 | 9/1925 | Stanage | 273/261 |
| 4,193,602 | 3/1980 | Eliot | 273/236 |

OTHER PUBLICATIONS

Quintessence; pp. 42 of *Games*; May/Jun. 1979; vol. 3, issue 3; Playboy Enterprises.

*Primary Examiner*—Richard J. Apley
*Assistant Examiner*—Carl Moy

[57] ABSTRACT

A game comprises a playing surface and a set of playing pieces. The playing surface is marked with interlocking closed chains of regular pentagons in side to side abuttment. In the preferred embodiment, pieces having pentagonal portions are assembled on the playing surface to form closed chains. In other embodiments, traditional games such as dominoes and checkers are adapted to the new playing surface. Many such playing surface designs are possible.

6 Claims, 16 Drawing Figures

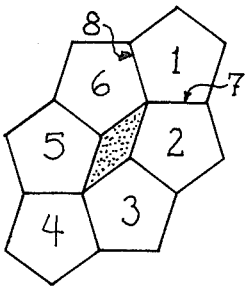
Fig. 1
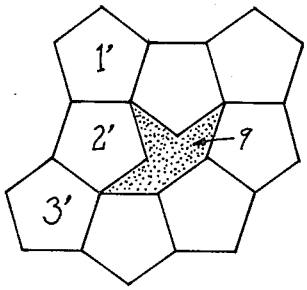
Fig. 2
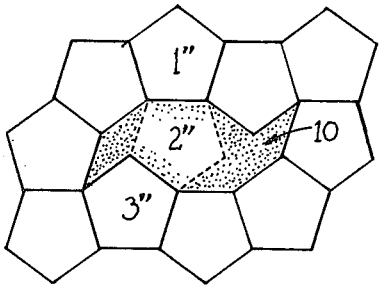
Fig. 3
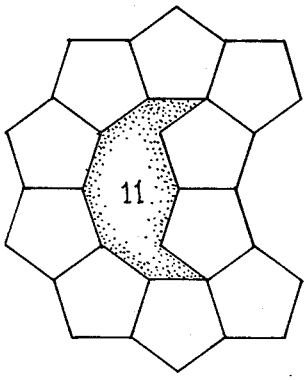
Fig. 4
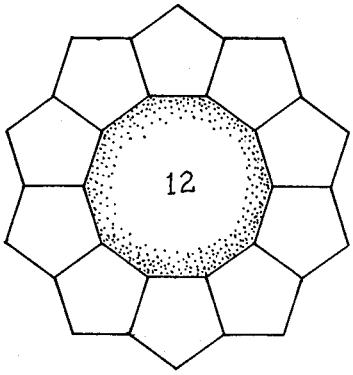
Fig. 5
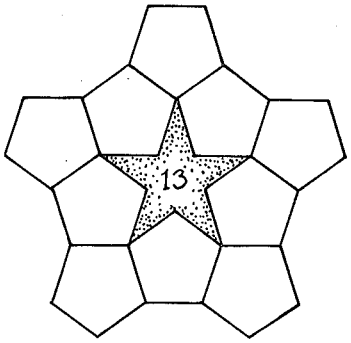
Fig. 6
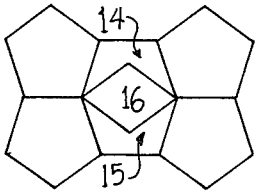
Fig. 7
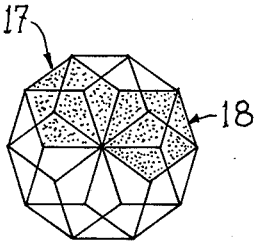
Fig. 8
Fig. 9
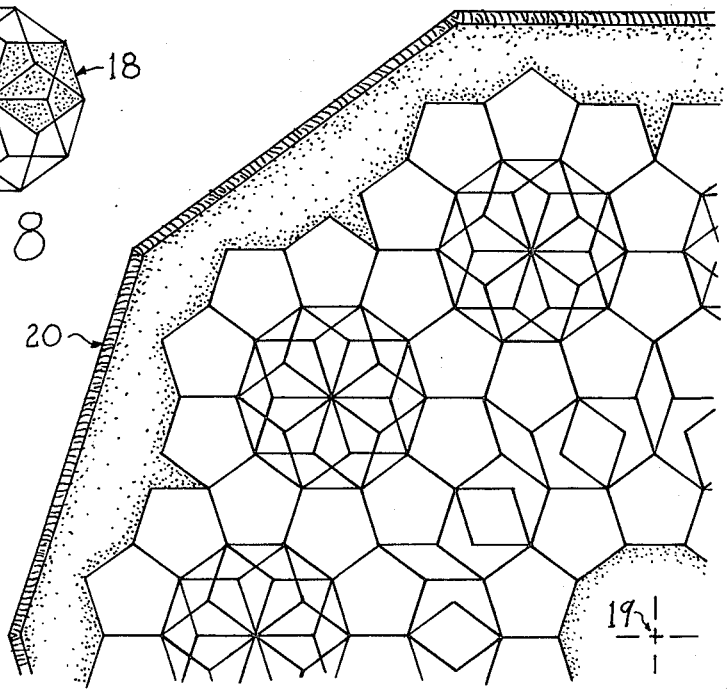
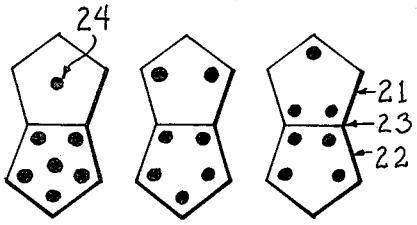
Fig. 10

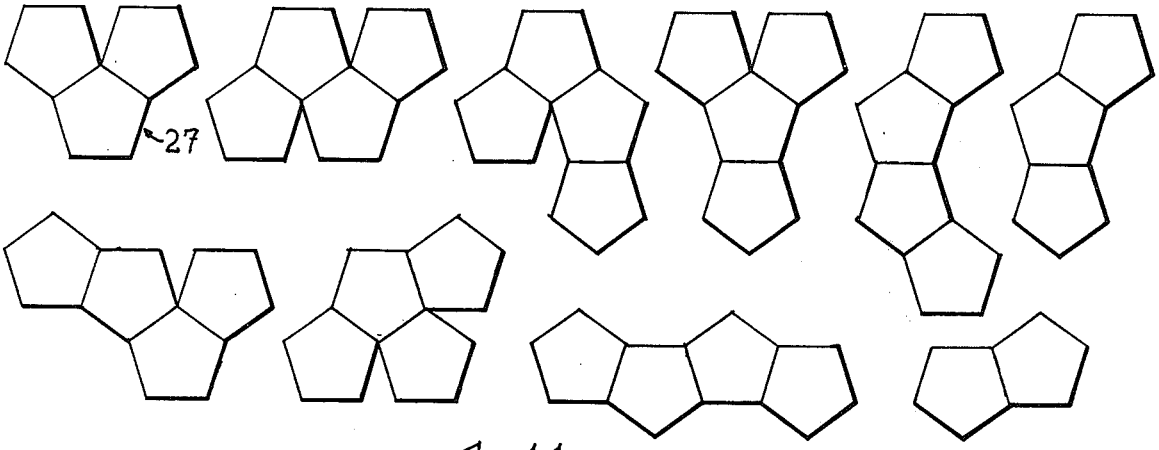
Fig. 11
Fig. 12
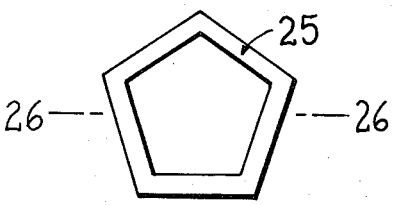
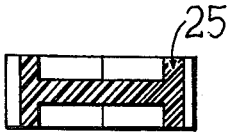
Fig. 13
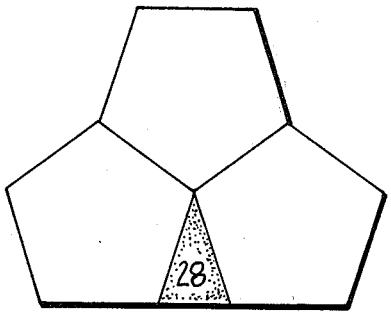
Fig. 14
Fig. 16
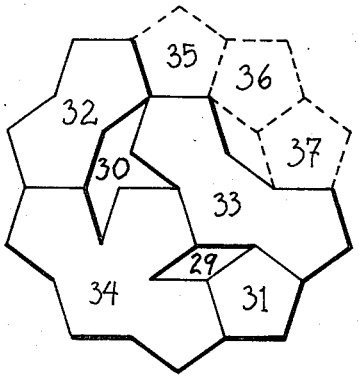
Fig. 15
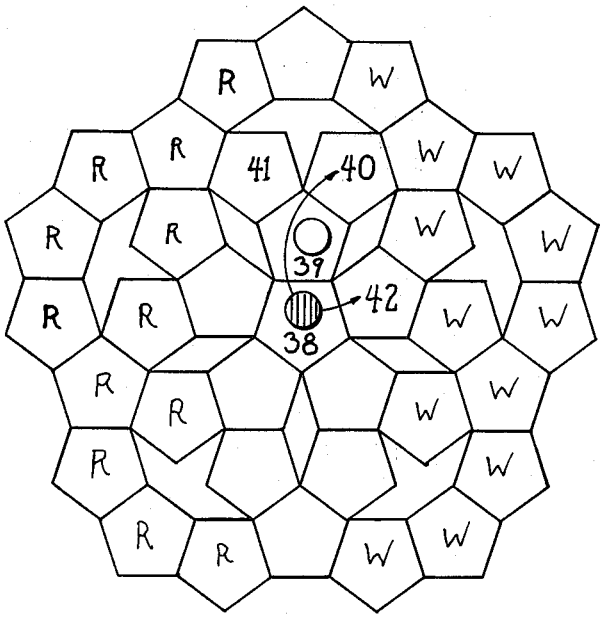

PENTAGONAL GAME EQUIPMENT

BACKGROUND OF THE INVENTION

This invention relates to games in which pieces are placed on a surface marked with a geometrical design.

Many traditional games involve the placement and movement of pieces upon a rectangular grid, or checkerboard. A variety of games, including dominoes and polyominoes, involve the assembly of pieces, each piece shaped as a plurality of squares connected in side to side abuttment. Go and chinese checkers are games involving a hexagonal grid, or honeycomb pattern. A game having irregular pentagonal pieces is disclosed in U.S. Pat. No. 3,981,505.

SUMMARY OF THE INVENTION

It is an object of the present invention to provide a new type of game based on the geometry of regular pentagons. Such pentagons may be connected in side to side abuttment to form closed chains. Each chain must have an even number of pentagons, since the pentagons alternately "point" in opposite directions. It is not difficult to prove that a chain must have at least six pentagons.

Only two distinct chains of six regular pentagons exist, but infinitely many longer chains may be derived from them. If a chain of $N+K$ pentagons and a chain of $M+K$ pentagons can be superimposed so that exactly $K+1$ consecutive pentagons coincide, then $K-1$ consecutive pentagons may be removed from the combined figure, leaving a new chain of $N+M$ pentagons.

These chains can be interlocked by superimposing pentagons, resulting in an even greater variety of designs which may be marked on a playing surface, or game board. In most cases, it is appropriate for the sides of the pentagons to have a unit length of about two centimeters.

In the preferred embodiment of the invention, pieces having pentagonal portions are placed on the playing surface, according to the markings. A number of players take turns placing these pieces, each player attempting to complete closed chains of pentagons. It may be desirable to provide a deck of playing cards, each card illustrating a configuration to be completed. Each player would be dealt two cards, and would only claim points on configurations shown on those cards.

In a second embodiment of the invention, a game of dominoes is played on the marked surface, using a set of bipentagonal dominoes. In a third embodiment, a game of checkers is played with pentagonal playing positions. The second and third embodiments are intended as examples of the adaption of traditional games to the new playing surface.

BRIEF DESCRIPTION OF THE DRAWINGS

FIGS. 1 to 8 show closed chains of regular pentagons in side to side abuttment, the side of each pentagon being of unit length.

FIG. 9 shows the playing surface used in the preferred embodiment.

FIG. 10 shows bipentagonal dominoes used in the second embodiment.

FIGS. 11 to 14 show pieces used in the preferred embodiment.

FIG. 15 shows the assembly of pieces in the preferred embodiment.

FIG. 16 shows the third embodiment.

DETAILED DESCRIPTION

FIG. 1 is a chain comprised of six congruent regular pentagons 1 to 6 surrounding a rhombus. When the first pentagon 1 abutts exactly with the second pentagon 2 along a side 7, and so forth, it can be proven according to Euclidean geometry that the chain will close with the sixth pentagon 6 abutting exactly with said first pentagon along another side 8.

FIG. 2 is a chain comprised of eight congruent regular pentagons surrounding a hat-shaped polygon 9 with seven sides of unit length and with apices defining consecutive angles of 144°, 36°, 252°, 36°, 252°, 36′, and 144°.

FIG. 3 is a chain comprised of ten congruent regular pentagons surrounding a wave-shaped polygon 10 with ten sides of unit length and with apices defining consecutive angles of 36°, 252°, 144°, 144°, 144°, 36°, 252°, 144°, 144°, and 144°. Note that this chain can be derived from FIGS. 1 and 2 by superimposing abutting pentagons 1, 2, and 3 over abutting pentagons 1′, 2′, and 3′ to get three abutting pentagons 1″, 2″, and 3″, then removing the central pentagon 2″. In this case, $K=2$, $N=4$, and $M=6$.

FIG. 4 is a chain comprised of ten congruent regular pentagons surrounding a crescent-shaped polygon 11 with ten sides of unit length and with apices defining consecutive angles of 144°, 36°, 252°, 144°, 252°, 36°, 144°, 144°, 144°, and 144°. This chain can be derived similarly from FIGS. 1 and 2 by superimposing different pentagons 2, 3, and 4 of FIG. 1 over the same pentagons of FIG. 2.

FIG. 5 is a chain comprised of ten congruent regular pentagons surrounding a regular decagon 12, forming a perfect ring. The chain can be derived from FIGS. 1 and 4, and thus it can be derived after two steps from FIGS. 1 and 2.

FIG. 6 is a chain comprised of ten congruent regular pentagons surrounding a five-pointed star 13.

FIG. 7 is a self-intersecting chain comprised of six congruent regular pentagons, in which two opposite pentagons 14 and 15 overlap to form a rhombus 16.

FIG. 8 is a self-intersecting chain comprised of ten congruent regular pentagons contained within a regular decagon, in which each pentagon overlaps with four others. Two of these pentagons 17 and 18 are shaded to clarify the abutting relationship. This chain can be derived after three steps from FIGS. 1 and 7.

FIG. 9 is a plan of a portion of the playing surface of the preferred embodiment, which may be made of paper or of any stiff substance such as cardboard. The markings are symmetrical with respect to a 36° rotation about a central point 19. The edge 20 of the surface may have any convenient shape. Ten "star chains" interlock around a central ring, and ten rings interlock to form the perimeter. Every chain from FIGS. 1–8 is marked on this playing surface, but there are many other possible designs which may or may not use all of the chains shown. It may be desirable to provide a booklet with a different playing surface design on each page, in order to add variety to the game.

FIG. 10 is a plan of typical bipentagonal dominoes playable on the surface of FIG. 9. Each piece is shaped as two congruent regular pentagons 21 and 22 abutting along a side 23. A complete set of such pieces would include all combinations of indicia 24 for the two pentagonal faces. Each piece would be permitted to cover any abutting pair of pentagons marked on the playing surface, provided that abutting pentagons of different pieces have identical indicia.

FIG. 11 is a plan of ten different pieces provided in the preferred embodiment. Each piece illustrated is shaped as a plurality of congruent regular pentagons connected in side to side abuttment. Six of each piece illustrated and twelve pentagonal pieces preferrably would be provided, divided into six differently colored sets. The design of pieces having five or more pentagons should be apparent from FIG. 11 to those skilled in the art.

FIG. 12 is a plan of a pentagonal playing piece having reinforced edges 25. This construction is appropriate for pieces molded from plastic. FIG. 13 is a section on line 26—26 of FIG. 12.

FIG. 14 is a plan of a playing piece 27 from FIG. 11 having a triangular reinforcement 28. This construction is appropriate for pieces cut from cardboard or wood.

FIG. 15 shows the assembly of the pieces in the preferred embodiment of the game. The markings on the playing surface are not shown except for three abutting pentagons 35, 36, and 37, and the markings and reinforcements of the pieces are omitted for clarity. Each pentagon of a piece is placed exactly on a pentagon marked on the board. The first three players have played three pieces 31, 32, and 34 on the board. The fourth player has then played the piece 33 formed from three pentagons, completing a closed chain of pentagons surrounding a rhombus 29. Now the fifth player may complete simultaneously two closed chains of pentagons, one around a hat-shaped polygon 30, and one around a crescent-shaped polygon, by covering one pentagon 35 in any way. If the fifth player has a piece congruent to that played by the fourth, he may cover three pentagons 35, 36, and 37, completing four chains simultaneously.

FIG. 16 is a plan of a variation of checkers played with thirty-six pentagonal playing positions arranged in five interlocking rings. Red begins with a piece on each of twelve pentagons labelled. "R", and White begins with a piece on each of twelve pentagons labelled "W". Pieces are permitted to move from any pentagon 38 to any abutting vacant pentagon 42. Also, if three pentagons form a row, the first 38 and third 40 abutting the second 39, a red piece on the first 38 may jump over a white piece on the second 39 to land on the third pentagon 40 if it is vacant. However, as in traditional checkers, a piece which is not "crowned" may not move backwards, or jump to a third pentagon 41 which is closer to its home territory. Thus permitted movements are restricted by the abutting relation among the pentagons, by the color of the pieces, and by whether or not the pieces are "crowned".

Other modifications and arrangements may be devised by those skilled in the art without departing from the spirit and scope of this invention and the appended claims are intended to cover such modifications and arrangements.

I claim as my invention:

1. A game comprising a playing surface marked with interlocking closed chains of regular pentagons in side to side abuttment, defining a unit length such that the side of each said pentagon is of said unit length, and a plurality of playing pieces playable on said surface, wherein said markings on said surface designate permitted playing positions for said playing pieces, in which at least one of said chains is a self-intersecting chain comprised of six congruent regular pentagons, in which two opposite pentagons overlap to form a rhombus.

2. A game according to claim 1 in which at least one other of said chains is comprised of eight congruent regular pentagons surrounding a hat-shaped polygon with seven sides of unit length and with apices defining consecutive angles of 144°, 36°, 252°, 36°, 252°, 36° and 144°.

3. A game according to claim 1 in which at least one other of said chains is comprised of ten congruent regular pentagons surrounding a crescent-shaped polygon with ten sides of unit length and with apices defining consecutive angles of 144°, 36°, 252°, 144°, 252°, 36°, 144°, 144°, 144° and 144°.

4. A game according to claim 1 in which at least one of said chains is comprised of ten congruent regular pentagons surrounding a five-pointed star.

5. A game according to claim 1 in which a plurality of said playing pieces are shaped substantially as a plurality of congruent regular pentagons connected in side to side abuttment.

6. A game according to claim 1 in which a plurality of said playing pieces are shaped substantially as regular pentagons with sides of said unit length.

* * * * *